United States Patent [19]

Tel

[11] Patent Number: 4,942,831

[45] Date of Patent: Jul. 24, 1990

[54] DEVICE FOR THE PROTECTED STORAGE OF OBJECTS

[75] Inventor: Teunis Tel, Groningen, Netherlands

[73] Assignee: Seculock B. V., Netherlands

[21] Appl. No.: 265,136

[22] PCT Filed: Jan. 20, 1988

[86] PCT No.: PCT/NL88/00001

§ 371 Date: Sep. 23, 1988

§ 102(e) Date: Sep. 23, 1988

[87] PCT Pub. No.: WO88/05490

PCT Pub. Date: Jul. 28, 1988

[30] Foreign Application Priority Data

Jan. 23, 1987 [NL] Netherlands ..... 8700165

[51] Int. Cl.[5] ..... E05G 3/00

[52] U.S. Cl. ..... 109/29; 109/41; 109/42; 109/35; 109/25

[58] Field of Search ..... 109/35, 20, 29, 30, 109/31, 32, 33, 34, 41, 42

[56] References Cited

U.S. PATENT DOCUMENTS

| | | | |
|---|---|---|---|
| 3,559,593 | 2/1971 | Munton | 109/42 |
| 3,851,202 | 12/1974 | Lamping | 109/31 |
| 4,363,279 | 12/1982 | Johanssa | 109/29 |
| 4,722,435 | 2/1988 | Mareels | 109/33 |
| 4,729,327 | 3/1988 | Demonbreun | 109/35 |
| 4,799,435 | 1/1989 | Boutroy | 109/32 |

FOREIGN PATENT DOCUMENTS

| | | |
|---|---|---|
| 2445429 | 7/1980 | France . |
| 8700165 | 1/1988 | Netherlands . |

*Primary Examiner*—Robert L. Wolfe

*Attorney, Agent, or Firm*—Ostrolenk, Faber, Gerb & Soffen

[57] ABSTRACT

Device for the protected storage of objects, comprising a closable container having an electrical security shield enclosing a storage space, damaging means (10) for rendering the objects useless, and means (4) for feeding in from the outside a command which disables the damaging means (10), the security shield comprising one or more electrical systems which at least togther extend over essentially the entire surface of the shield and which cooperate with a processing circuit (14) which detects an electrical parameter of each system, and which is capable of delivering an activation command to the damaging means (10) when a detected parameter value deviates from a reference value.

27 Claims, 4 Drawing Sheets

DEVICE FOR THE PROTECTED STORAGE OF OBJECTS

The invention relates to a device for protected storage of objects.

A device of this kind is known from French Patent Application 2,445,429. In the known device the security shield consists of two electrically conducting layers which are separated from each other by an insulating layer and which are disposed against or preferably in the walls of the container. The processing circuit is arranged in such a way that if a short-circuit occurs between the electrically conducting layers which are separated from each other, the damaging means are activated.

In the known device it is possible to damage each of the layers without the damaging means being activated. By using a drill of electrically insulating material or by using a laser beam, it is, for example, possible to remove material from the electrically conducting layers without a short-circuit occurring between the layers. In this way a hole can be formed in a wall of the container and means can be conveyed into the container through the hole to prevent the damaging means from working properly, so that the objects can be removed from the container without damage to them. In order to limit the chance of short-circuiting, material can be removed from the outer electrically conducting layer first over a greater area than from the inner electrically conducting layer. This process can be used irrespective of the number of electrically conducting layers which are insulated from each other and for which the occurrence of short-circuiting between them is monitored.

The object of the invention is to eliminate the disadvantages of the known device.

This object is achieved according to the invention by means of the device described below.

If on damage to one or more of the electrical systems of the security shield the value of a parameter detected by the processing circuit deviates from a reference value, the damaging means will be activated.

The systems can extend over surfaces with various dimensions, the systems can overlap, and the processing circuit can detect various parameters of systems of differing design.

In a preferred embodiment a system is made up of a layer of electrically conducting material having two electrodes which are connected to the processing circuit and are arranged at a distance from each other, the parameter of the system corresponding to the resistance of the layer. The layer cf electrically conducting material can be formed by a quantity of material extending uniformly over the surface of the system, by a mesh structure, and preferably by a track pattern. If material is removed from the layer, the resistance thereof will change, and the damaging means will be activated. If an electrically conducting layer in the form of a track pattern is used, the processing circuit can detect not only whole, but also partial, piercing of the track, and in response to this can give the activation command to the damaging means. The resistance of a system formed by a layer—which may include a track pattern—of electrically conducting material can be determined by applying a voltage over the electrodes or passing a current through the layer and monitoring the voltage over the electrodes or the current through the layer and comparing it with a reference value. Where a track pattern is used it is possible to have an embodiment of the device in which only full piercing of the track is monitored, thus a change from a finite resistance value to an infinite resistance value. If a material with a high resistance temperature coefficient for the electrically conducting layer is used, temperature changes occurring through break-in attempts can be detected for producing in response thereto the activation command for the damaging means. For the detection of a local removal of material from an electrically conducting layer it is preferable for the cross-section resistance thereof to be relatively high. This can, for example, be achieved by making the layer, including a layer formed by a track pattern, of a fine-mesh structure, thus with small pores, it being possible for the material to be, for example, ordinary copper.

A system can comprise a layer of piezoelectrical material having electrodes fitted on the layer, in which when pressure is exterted on the layer or if it is damaged, a voltage is produced and is detected by the processing circuit for giving an activation command in response thereto to the damaging means.

A system can also be a layer of electret material having applied to the layer electrodes between which there is a potential depending on the material. When the layer is damaged, for example by piercing, the potential over the electrodes changes, and the processing circuit will produce an activation command for the damaging means.

A system can also be made up of two electrically conducting layers which are connected to the processing circuit and are separated from each other by an electrically insulating layer, the parameter of the system corresponding to the capacity between the conducting layers. If material is removed from one of the electrically conducting layers, if the system is crushed, or if there is short-circuiting of the electrically conducting layers, the capacity changes and the processing circuit will deliver an activation command to the damaging means.

In order also to permit detection of small, relatively slow changes in the value of a parameter and in response thereto to generate an activation command for the damaging means, the processing circuit preferably carries out a differentiation of the parameter value.

The container is preferably a cassette and a slide to be pushed into the cassette and having a recess for holding the objects, and the cassette and the slide have mating connecting means for obtaining a connection to each system disposed at least partially in the cassette or in the slide. This forms a design of the container which is easy to use and is effectively burglar-proof without hinges which are not burglar-proof, and without external locking means. The various sytems of the security shield of the cassette and of the slide can be fitted in a simple manner in such a way that together they comprise the entire storage space for the objects and ran overlap even over a relatively large area, in particular in the case of the slide-in opening of the cassette.

The invention will be explained with reference to the drawing, in which

FIG. 3 shows a carrier, provided with a track system, for the cassette shown in FIG. 1.

Figure 1:
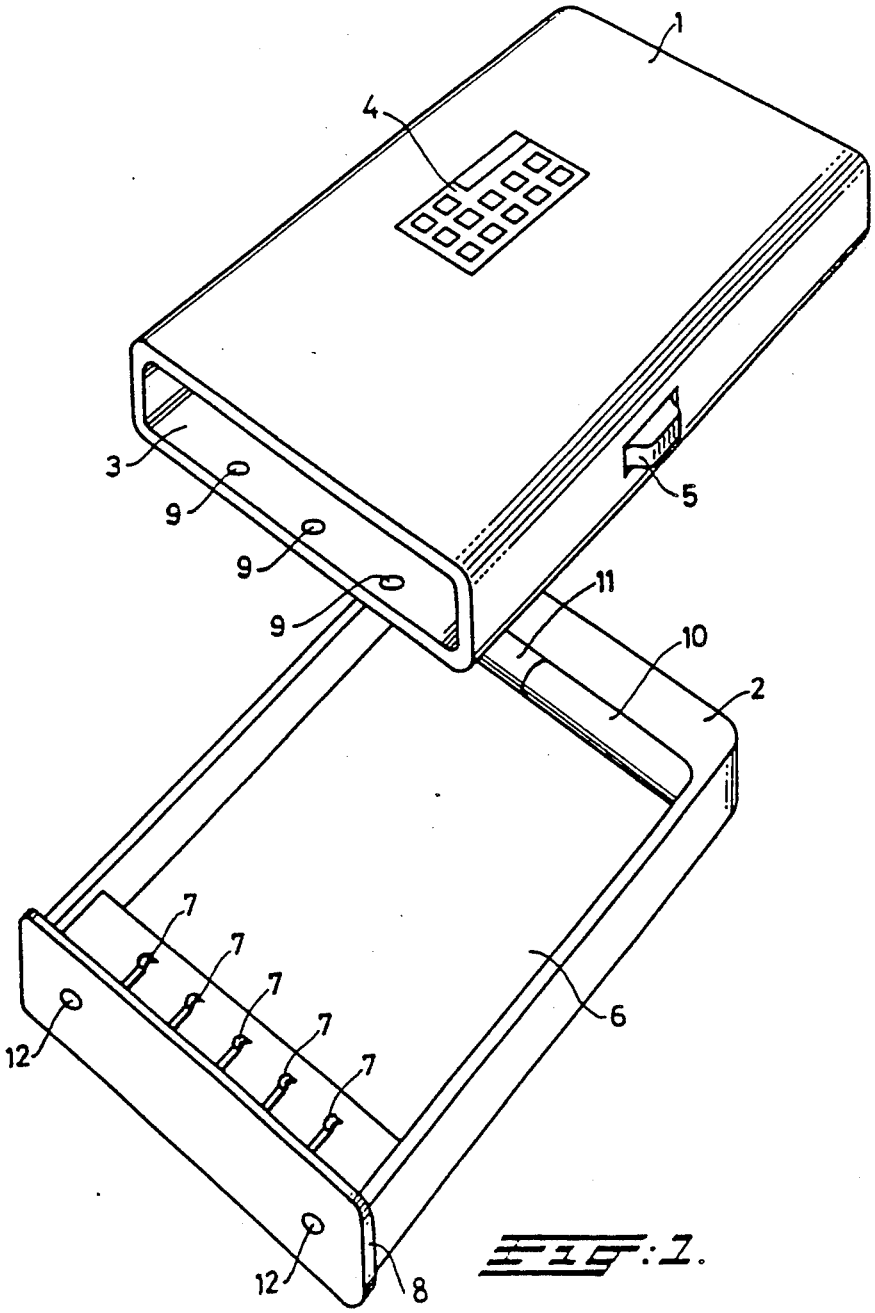
FIG. 1 shows in perspective a view of an embodiment of the container of the device according to the invention.

The container shown in FIG. 1 comprises a cassette 1 and a slide 2 which can be pushed into the cassette 1 through a slide-in opening 3 of the cassette 1. The cassette 1 has a keyboard 4 and an unlocking control knob 5 which are electrically connected :n a manner explained below to a processing circuit of the device. The slide 2 has a recess 6, on the bottom of which objects, in particular a stack of securities, can be placed. An electronic processing circuit, which in reality can comprise a microprocessor, is disposed in the bottom of the recess 6. The processing circuit is connected by means of conductors, which are not shown, to a number cf flexible sliding contacts 7 at the head end 8 of the slide 2. Sliding contacts can also be provided at other places, such as the siding contacts 7 on the slide 2, and they can be connected by means of connectors to the processing circuit. When the slide 2 is pushed fully into the cassette 1, a number of sliding contacts 7 will be connected to contact pads 9 of electrical systems which are disposed against or in the walls of the cassette 1 and which belong to the security shield of which the processing circuit detects an electrical parameter. At least one electrical system of the security shield is also disposed in the head section 8 of the slide 2. When the slide 2 is inserted into the cassette 1, the storage space for the objects formed by the recess 6 is then fully enclosed by one or more electrical systems of the security shield connected to the processing circuit.

The slide 2 contains damaging means which are connected to the processing circuit and which can be formed by a tubular cartridge 10 which bursts on receipt of an activation command from the processing circuit, so that a liquid which it contains is spout over the objects in the recess 6. For the storage of a stack of securities of equal dimension it is preferable for the wall of the recess 6 opposite the cartridge 10 to be of a shape complementary to the cartridge 10, and for the distance between said wall and the cartridge 10 to be equal to one of the dimensions of the papers. When the cartridge 10 bursts, the liquid in it will then penetrate very effectively between the papers and thereby make them very clearly unusable. The cartridge 10, with the exception of the side thereof which faces the recess 6, is preferably surrounded by rigid material which is such that it does not become deformed when the cartridge 10 bursts. In this way the maximum effective thrust of the liquid from the cartridge 10 in the direction of the recess 6 is obtained.

The slide 2 can have an electromechanical locking mechanism 11 which locks the slide 2 to the bottom of the cassette 1. The electromechanical locking mechanism !1 is preferably of the bistable type, so that it takes up current only on receiving a relatively short control signal.

An access code belonging to the container is stored in a memory of the processing circuit. When the user feeds the same code into the processing circuit by means of a keyboard 4, he will subsequently, by pressing the button 5, be able to generate an energizing signal for the locking mechanism 11 for opening of the container. The device can be designed in such a way that when the user enters a certain number of times in succession a code which is not the same as the individual stored access code, the device is put out of action for a predetermined period of time, possibly permanently, or an activation command is delivered to the cartridge 10. Optical and acoustical signal transmitters, such as light indicators 12 provided in the head part 8 of the slide 2, can be connected to the processing circuit for checking of the state of the device, in particular when the stages for opening of the container are being carried out.

Figure 2:
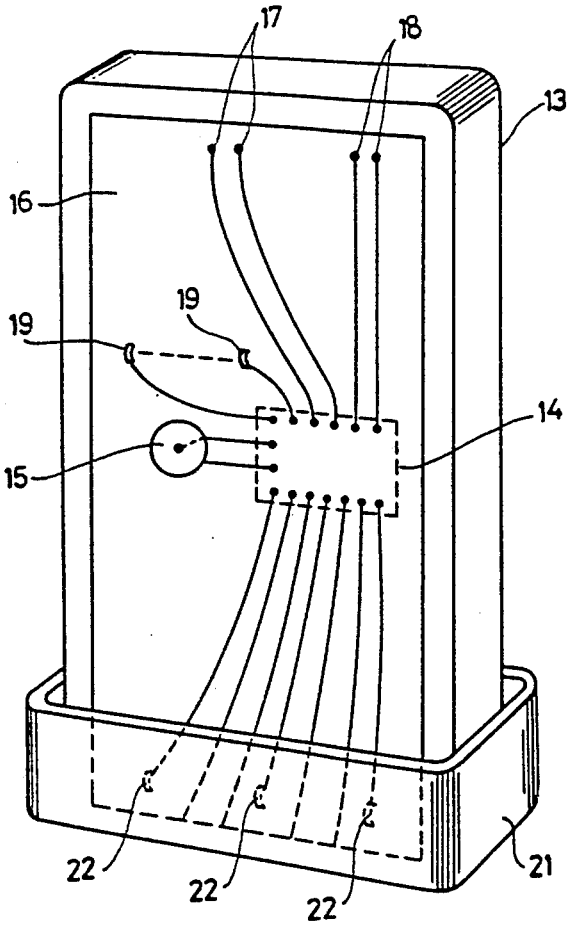
FIG. 2 shows in perspective and on a larger scale another embodiment of a slide of the container of the device according to the invention.
Figure 5:
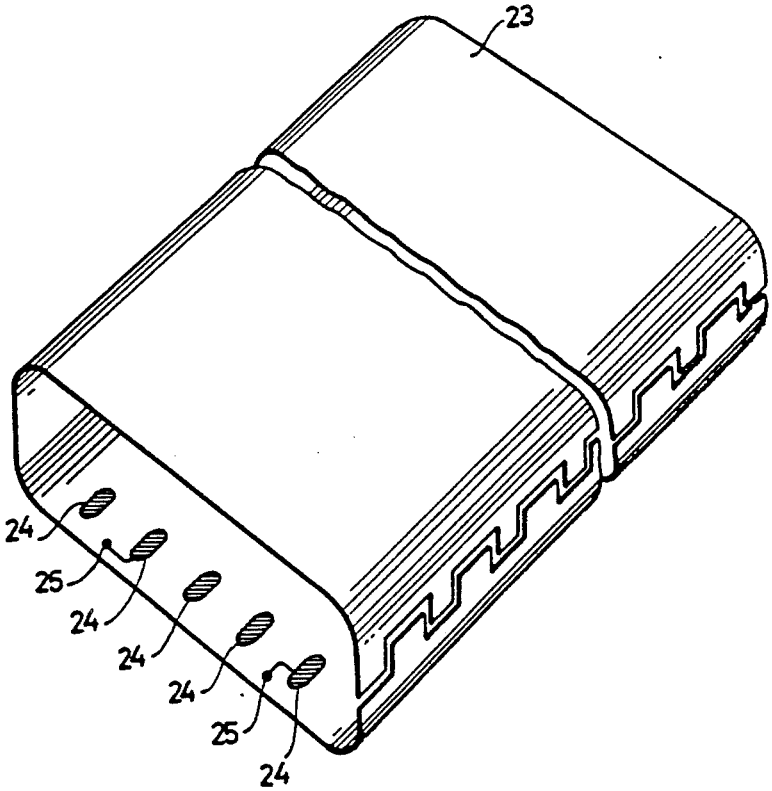

FIG. 2 shows, on a larger scale, another embodiment of a slide 13 of a container of the device according to the invention, which can be pushed into a cassette, such as the cassette 1 of FIG. 1. FIG. 2 shows the slide 13 from the other side from that shown of the slide 2 of FIG. 1. The bottom of the recess provided in the slide 13 contains an electronic processing circuit 14 and a battery 15 connected to the processing circuit 14. An insulating carrier 16 having conductor tracks connected to the processing circuit 14 is disposed over the large side of the slide 13 shown in FIG. 2. Two tracks having connecting pads 17 for connection of the damaging means, such as a cartridge 10 of the slide 2 shown in FIG. 1. Two other tracks have connecting pads 18 for connection of an electromechanical locking mechanism such as the mechanism 11 of the slide 2 shown in FIG. 1. A number of other tracks, only two of which are shown, have sliding contacts 19 for connection to tracks connected to the keyboard 4 when the slide 13 is inserted into the cassette 1. A number of other tracks are diverted through the head part 21 of the slide 13 in such a way that on the side of the slide 13 not shown they are connected to sliding contacts, such as the sliding contacts 7 of the slide 2 of FIG. 1. A number of other tracks have sliding contacts 22 which are functionally comparable to the sliding contacts 7. Other tracks which are not shown are connected to the light indicators 12, by means of a sliding contact connection to the button 5, and to at least one electrical system of the security shield disposed in the head part 21.

FIG. 3 shows in perspective a carrier 23 of electrically insulating material which can be provided against all inside walls of the cassette 1. The carrier 23 has on at least one side thereof one or more arbitrarily running patterns of tracks of electrically conducting material, which for the sake of clarity are not shown. The ends of each track, or of a number of tracks connected in series, emerge on two contact pads, such as 24, which are connected to opposite sliding contacted such as 7, 19 or 22, and thereby to the processing circuit 14, once the slide 2, 13 has been inserted into the cassette 1. The tracks are very small in width and have a correspondingly small space between them, for example less than 0.5 mm. When a pattern of tracks is provided on the outside of the carrier 13, the tracks thereof are connected by means of through-metallization, as at 25, to the inside edge of the carrier 23, and thereby to contact pads such as 24. Similar track patterns of electric ally conducting material can be provided in the head part 8, 21 of the slide 2, 13.

Since the dimensions of the tracks and the intervals between them are so small and the tracks are preferably disposed in at least two layers, inter alia, on the inside and the outside of the carrier 23, a track will almost always be interrupted when a wall of the cassette 1 or of the slide 2, 13 is pierced. The resistance of said track then becomes infinitely great, which is detected by the processing circuit 14, thereby causing the latter to deliver an activation command to the damaging cartridge 10. If material with a relatively high specific resistance is used for the tracks, or if the tracks are designed with relatively high cross-sectional resistance, for example with a large number of small pores, the processing circuit 14 can detect even partial interruption of a track. Through use of material with a relatively high resistance temperature coefficient for the tracks, the processing circuit 14 can detect even a very local temperature increase in or near a track, for example if a laser beam is used when piercing the carrier 23. The processing circuit 14 can detect shortcircuiting between various tracks connected to the processing circuit 14 and, irrespective of the design of the tracks, can detect partial short-circuiting of each of the individual tracks and in response thereto deliver an activation command of the damaging cartridges 10.

If track patterns are provided both on the inside and on the outside of the carrier 23, it is preferable that in the event of projection of the tracks from the various sides in each other's plane there are nc spaces between the tracks, so that it is impossible to form a hole in the carrier 23 without touching a track.

A track pattern provided on the outside of the carrier 23 preferably extends to at least opposite the contact pads, such as 9, 24, on the inside of the carrier 23. This means that such contact pads are difficult to reach for sabotage purposes from the outside without damaging the track pattern provided over them.

Such contact pads 9, 24 can also be shielded by a collar of the head part 21 of the slide 13, in which part of the security shield is disposed, and which extends over the contact pads 9, 24 when the slide 13 is pushed in.

The vertical walls of the carrier 23 shown in FIG. 3 can be replaced by connecting strips of insulating material having a large number of vertical-running electrical conductors with very small diameters which ensure the connection between the tracks of the rest of the carrier 23.

The carrier 23 can also be designed in such a way that the edge parts which are folded towards each other overlap and have opposite small recesses, such at in conductor tracks to be connected, containing an electrically conducting adhesive. The adhesive here performs the function of mechanical fixing and the fuction of electrical connection. The overlapping of edge parts of the carrier also improves the impenetrability thereof.

A layer of piezoelectrical material having electrodes applied to the layer and connected to the processing circuit 14 can be disposed on the carrier 23, so that if the layer is crushed or damaged a voltage is generated and is detected by the processing circuit for the production of an activation command for the damaging cartridge 10.

A layer of electret material having electrodes connected to the processing circuit 14 can also be provided on the carrier 23, so that if the layer is damaged the potential thereof changes, causing the processing circuit 14 to generate an activation command for the damaging cartridge 10.

The carrier 23 can also carry two electrically conducting layers which are connected to the processing circuit 14 and are separated from each other by an electrically insulating layer, the capacity between the electrically conducting layers forming a parameter to be detected by the processing circuit 14.

The head part 8, 21 of the slide 2, 13 can in similar fashion have a layer of piezoelectrical material, a layer of electret material, of two electrically conducting layers which are insulated from each other.

The keyboard 4 has connections which are connected to connection pads (not shown)—provided on the carrier 23—of tracks which have at their other end contact pads which are opposite sliding contacts, such as 19, when the slide 8, 21 is pushed in. The keyboard and its connections with the processing circuit 14 detects an electrical parameter, so that if the keyboard 4 is damaged, for example if it is removed, the processing circuit 14 delivers an activation command to the damaging cartridge 10.

Figure 4:
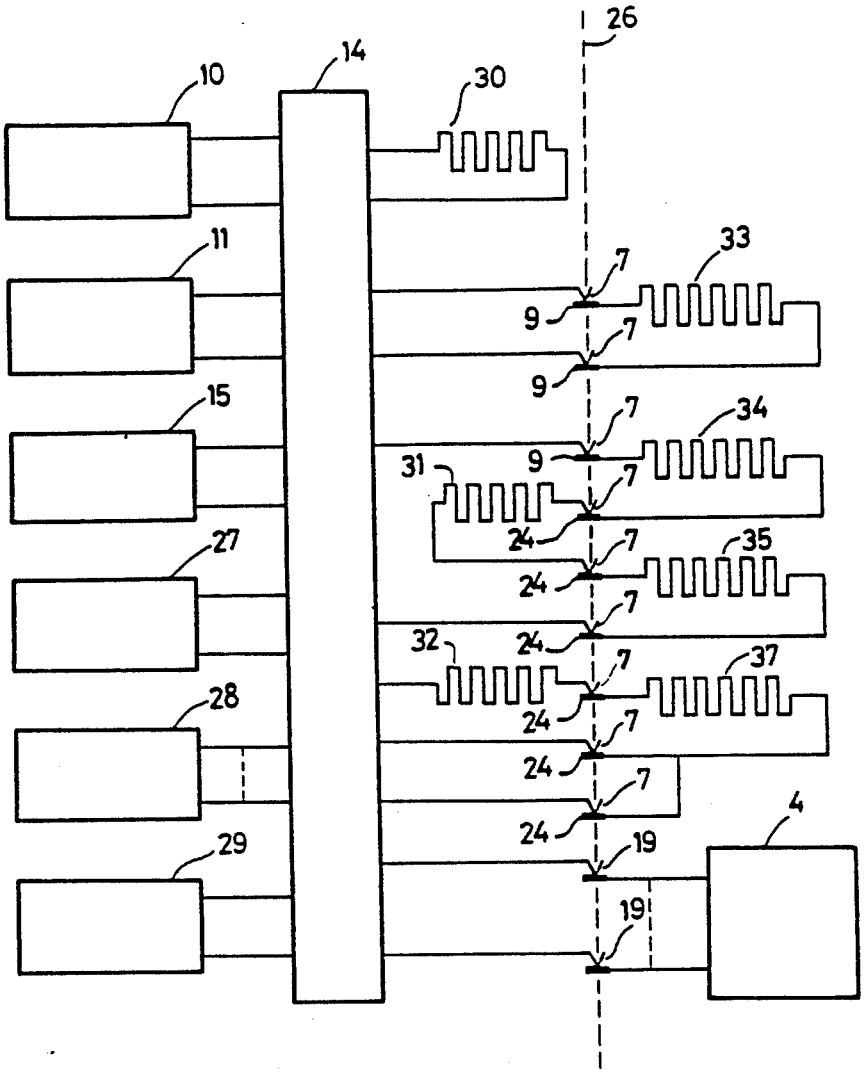
FIG. 4 is a wiring diagram of the electrical part of the device to the invention.

FIG. 4 shows a wiring diagram of an embodiment of the electrical part of the bevice according to the invention.

The part of the diagram shown on the right side of the dotted line 26 in FIG. 4 is provided in the cassette 1, and the part shown to the left of the dotted line 26 is provided in the slide 2, 13. The connection between the parts of the cassette 1 and of the slide 2, 13 takes place, as explained, by means of sliding contacts such as 7, 19 and 22, which are in contact with opposite contact pads, such as 24, connected to the processing circuit 14 when the slide 2, 13 is pushed in.

The processing circuit 14 is supplied by the battery 15. A temperature sensor 27 and a pressure sensor 28 are connected to the processing circuit 14 for detection of the temperature and the pressure respectively in the accommodation area of the container and for delivery of an activation command to the damaging cartridge 10 when a detected value thereof deviates from a reference value. The optical and/or acoustic signalling means connected to the processing circuit 14, such as the light indicators 12, are indicated by the reference number 29.

The diagram contains a number of electrically conducting tracks of the security shield of the device according to the invention, such as the tracks 30, 31 and 32 provided in the head part 8, 21 of the slide 2, 13 and the tracks 33 to 36 provided in the cassette 1. As explained, when the slide 2, 13 is pushed in, the procesing circuit 14 can detect damage to one or more of the tracks 30 to 37 or short-circuiting between the various tracks or of parts of any of them and in response thereto can deliver an activation command to the damaging cartridge 10. It is pointed out that FIG. 4 only shows an example of the number of tracks used and of the way in which they are connected to each other and to the processing circuit 14. As explained it is possible to have instead of such tracks or as an addition thereto electrical systems of another type connected to the processing circuit 14, in which case the processing circuit detects various parameters of various systems.

The processing circuit 14 and other electrical parts, such as the battery 15, the temperature sensor 27, the pressure sensor 28 and the signalling means 29 can be disposed in the cassette 1, enclosed by the security shield, instead of being in the slide 2, 13.

For the connection between the electrical parts, including the electrical systems of the security shield, of the cassette 1 and of the slide 2, 13, the sliding contacts can be replaced by a cable, in particular a flat cable, which is folded up on the bottom of the cassette 1 when the slide 2, 13 is pushed in.

The locking mechanism can be suitable for moving the slide 2, 13 relative to the cassette 1 when an unlocking signal is received from the processing circuit 14. This can form an indication for the user that the code has been properly entered and that the slide 2, 13 can be withdrawn further from the cassette 1 without the generation of an activation command for the damaging means.

It is also pointed out that the container cf the device according to the invention can also be designed in a different form than that of a cassette 1 and a slide 2, 13 to be inserted into it, and can be suitable for the storage of objects of any shape and any dimensions. The damaging means can be adapted to the specific design of the container and can comprise, for example, explosive material.

I claim:

1. A device for the protected storage of objects comprising:

a closable container, comprising a slide having a recess defined in it for accommodating objects therein and a cassette into which the slide is insertable; the cassette, the slide and the recess being respectively so shaped that with the slide fully inserted into the cassette, access into the recess in the slide is blocked.

damaging means in the container and communicating into the recess and being operable for damaging objects in the recess; command feeding means accessible from the exterior of the container and operable for disabling the damaging means from operating;

an electrical security shield comprising at least one electrical system which extends essentially over the entire surface of the container, including the cassette and the slide;

a processing circuit connected to each of the electrical systems for detecting an electrical parameter of the respective system, the processing circuit being connected with the damaging means for delivering an activation command to the damaging means when a detected parameter value in any of the electrical systems deviates from a reference value and when the command feeding means has not disabled the damaging means;

each of the cassette and the slide having respective matable connecting means wherein one part of the connecting means is on the cassette and the other part is on the slide, and the connecting means being so placed on the cassette and on the slide that the matable connecting means are in engagement when the cassette is inserted into the slide and the connecting means are disengaged as the cassette is separated from the slide;

a respective set of the connecting means of the slide and of the cassette being connected with each of the electrical systems, such that when the set of connecting means of the cassette and the slide are in engagement, they are connected to the respective electrical system and are connected to the respective processing circuit.

2. Device according to claim 30, wherein each system is comprised of a layer of electrically conducting material having two electrodes which are connected to the processing circuit and are arranged at a distance from each other, the parameter of the system corresponding to the resistance of the layer.

3. Device according to claim 2, wherein each system includes respective connections to it, the processing circuit comprises a voltage source for connection to the connections of the system, and the processing circuit is for measuring the current through the system for determination of the resistance value of the system corresponding to the current.

4. Device according to claim 2, wherein each system includes respective connections to it, the processing circuit comprises a current source for connection to the connections of the system, and the processing circuit is for measuring the voltage between the connections of the system for determination of the resistance value of the system corresponding to the voltage.

5. Device according to claim 2, wherein the material has a high resistance temperature coefficient.

6. Device according to claim 2, wherein the between the electrodes thereof, the layer has such high cross-sectional resistance that the processing circuit can detect partial rupturing of the layer.

7. Device according to claim 2, wherein the layer is at least partially of a fine-mesh structure.

8. Device according to claim 2, wherein the layer is formed by at an electrical insulating layer, the parameter of the system corresponding to the capacitance between the conducting layers.

9. Device according to claim 8, wherein opposite the spaces between the track parts of a track of one of the layers there are the track parts of a track of another of the layers insulated relative to the one layer.

10. Device according to claim 8, wherein each layer has connection pads, and part of one layer extends opposite the connection pads of another layer.

11. Device according to claim 8, wherein the respective tracks of a plurality of the layers are connected in series when the container is closed.

12. Device according to claim 1, wherein at least one system comprises a layer of piezoelectrical material having electrodes applied to the layer.

13. Device according to claim 1, wherein at least one system comprises a layer of electret material having electrodes applied to the layer.

14. Device according to claim 1, wherein at least one of the systems comprises two electrically conducting layers which are connected to the processing circuit and an electrical insulating layer, the parameter of the system corresponding to the capacitance between the conducting layers.

15. Device according to claim 1, wherein the processing circuit differentiates the parameter value preceding comparison with the reference value.

16. Device according to claim 1, wherein the processing circuit is suitable for detection of a short-circuit between two of the systems and on detection thereof for delivery of the activation command to the damaging means.

17. Device according to claim 1, wherein the connecting means comprise contacts pads and flexible sliding contacts mating therewith.

18. Device according to claim 17, wherein the slide of the cassette has an infeed opening; and part of the connecting means is disposed a short distance away from the infeed opening.

19. Device according to claim 1, wherein the damaging means comprise a cartridge with a damaging medium which is explosive by means of the activation command and the cartridge is disposed along an edge of the recess of the slide and, the cartridge is surrounded on all sides except the side facing the recess by essentially the shape-retaining material when the cartridge explodes, and the recess at the slide is suitable for placing a stack of flat objects therein with slight play in the recess of the slide and against the cartridge.

20. Device according to claim 19, wherein the cartridge has a curved surface to be rested against the object in the recess, and an opposite upright edge of the recess of the slide is of a complementary shape.

21. Device according to claim 1, wherein the slide of the cassette has an infeed opening; a head part of the slide which is closest to the infeed opening when the container is closed has a collar which extends over the edge part of the infeed opening of the cassette when the container is closed, and at least a part of at least one of the systems running opposite the connecting means disposed at the infeed opening.

22. Device according to claim 1, wherein the cassette includes opposite walls, at least part of at least one of the systems is provided on each of two of the opposite walls of the cassette, the walls having edges and along the edges of the walls are connecting strips of insulating material with a large number of electrically conducting filaments running at right angles to the walls, the filaments for ensuring the connection between parts of at least one of the systems.

23. Device according to claim 1, further comprising a carrier on which a system is disposed, the carrier is to be fitted opposite and against the walls of the cassette and has overlapping edge parts in which recesses are provided opposite each other in conductors of the system formed on the carrier, and an electrically conducting adhesive provided in the recesses.

24. Device according to claim 1, wherein the means for feeding in from the outside a command for disabling the damaging means comprise a keyboard which is fixed to the container and at least part of at least one of the systems and cooperating with the processing circuit.

25. Device according to claim 1, comprising an electromechanical locking mechanism which, on receipt of an unlocking signal produced in response to the infeed of the command for disabling the damaging means, is positioned and operable for unlocking a passage for the objects of the container.

26. Device according to claim 25, wherein the locking mechanism comprises a bistable element which in receipt of the unlocking signal maintains the state which unlocks the container until a subsequent energization.

27. Device according to claim 25, wherein the locking mechanism is connected to moves the slide relative to the cassette on receipt of the unlocking signal.

* * * * *